US007913723B2

(12) United States Patent
Stuhlbacher et al.

(10) Patent No.: US 7,913,723 B2
(45) Date of Patent: Mar. 29, 2011

(54) METHOD FOR FILLING A CONTAINER WITH GAS

(75) Inventors: Franz Stuhlbacher, Graz (AT); Erich Stuhlbacher, Graz (AT); Peter Konradt, legal representative, Graz (AT); Georg Kocevar, Graz (AT)

(73) Assignee: Exess Engineering GmbH, Graz (AT)

( * ) Notice: Subject to any disclaimer, the term of this patent is extended or adjusted under 35 U.S.C. 154(b) by 1055 days.

(21) Appl. No.: 10/599,756

(22) PCT Filed: Apr. 5, 2005

(86) PCT No.: PCT/AT2005/000118

§ 371 (c)(1),
(2), (4) Date: Jan. 4, 2007

(87) PCT Pub. No.: WO2005/098307

PCT Pub. Date: Oct. 20, 2005

(65) Prior Publication Data

US 2007/0272324 A1 Nov. 29, 2007

(30) Foreign Application Priority Data

Apr. 9, 2004 (AT) ..... A 625/2004

(51) Int. Cl.
*B65B 1/04* (2006.01)
*B65D 85/00* (2006.01)

(52) U.S. Cl. ..... 141/110; 141/3; 141/20; 206/0.7

(58) Field of Classification Search ..... 141/1, 3, 141/9, 11, 20, 69, 100, 110, 286; 220/88.1, 220/88.2; 206/0.6, 0.7
See application file for complete search history.

(56) References Cited

U.S. PATENT DOCUMENTS 3,773,168 A 11/1973 Meinass
4,566,589 A * 1/1986 Poschinger ..... 206/0.6
4,611,641 A 9/1986 Carter, Sr.
(Continued)

FOREIGN PATENT DOCUMENTS

EP 0669176 8/1995
(Continued)

OTHER PUBLICATIONS

U.S. Appl. No. 10/563,837 to Stuhlbacher et al., filed Jan. 9, 2006 and entitled, "Device for Producing Expanded Flat Material".

*Primary Examiner* — Timothy L Maust
(74) *Attorney, Agent, or Firm* — Greenblum & Bernstein, P.L.C.

(57) ABSTRACT

The invention relates to a method for filling a container with gas, gas being inserted into the container under compression. In order to be able to fill the container with a larger amount of gas than before and to reduce gas pressure peaks during filling, it is proposed according to the invention that electrically conducting stretched material is inserted into the container before it is filled with gas. Furthermore, the invention relates to a gas container (1), in particular a high-pressure gas cylinder, for storing gases under pressures exceeding 50 bar, in particular exceeding 200 bar, which contains electrically conducting stretched material (11). With gas containers (1) according to the invention, a higher filling level is achieved than before with a given pressure. Containers with a small wall thickness can be used without a safety risk because of a reduction of gas pressure peaks in the interior of containers.

6 Claims, 1 Drawing Sheet

U.S. PATENT DOCUMENTS

| | | | | |
|---|---|---|---|---|
| 4,613,054 | A | 9/1986 | Schrenk | |
| 4,925,053 | A * | 5/1990 | Fenton et al. | 220/88.1 |
| 5,207,756 | A | 5/1993 | Alhamad et al. | |
| 5,247,822 | A | 9/1993 | Spaeth | |
| 5,781,976 | A | 7/1998 | Stuhlbacher et al. | |
| 6,073,665 | A | 6/2000 | Takeyama et al. | |
| 6,635,119 | B1 * | 10/2003 | Tunney et al. | 134/19 |
| 2003/0094002 | A1 | 5/2003 | Hibino et al. | |
| 2004/0089151 | A1 | 5/2004 | Wang et al. | |

FOREIGN PATENT DOCUMENTS

| | | |
|---|---|---|
| GB | 2227370 | 7/1990 |
| WO | 2005/005073 | 1/2005 |

* cited by examiner

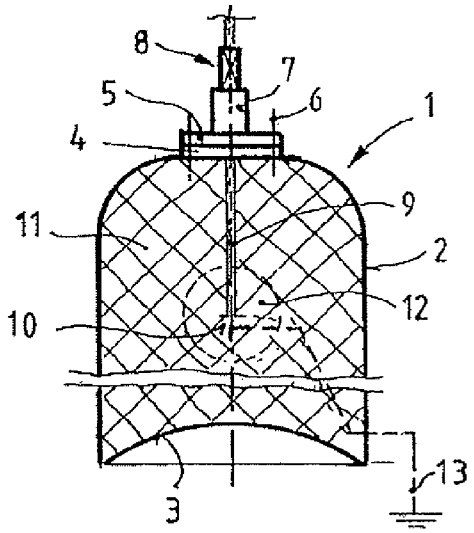
Fig.1
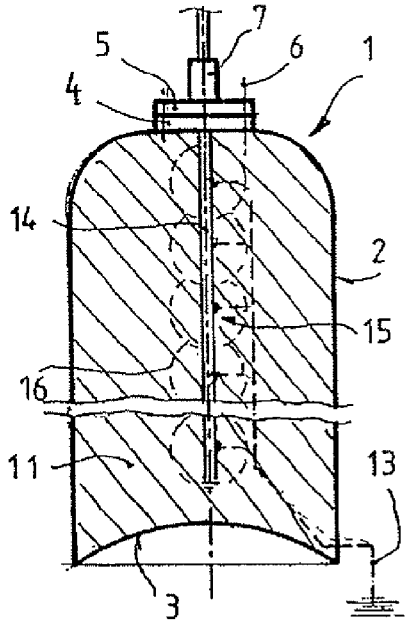
Fig. 2
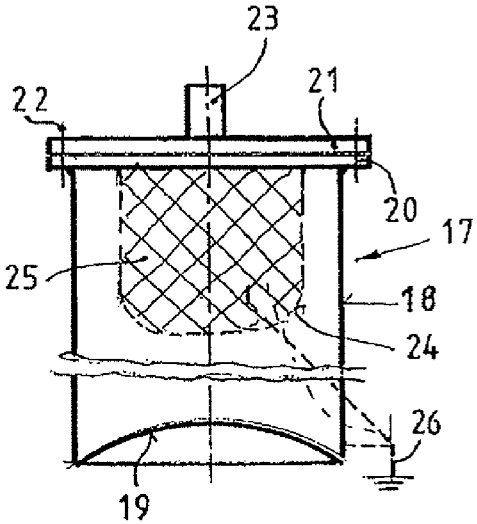
Fig.3
Fig.4
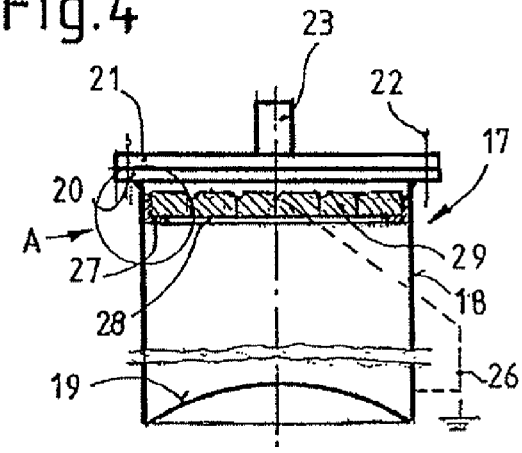
Fig.5
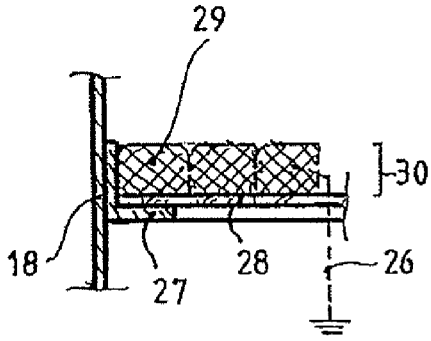
Section A

METHOD FOR FILLING A CONTAINER WITH GAS

CROSS-REFERENCE TO RELATED APPLICATIONS

The present application is a U.S. National Stage of International Application No. PCT/AT2005/000118, filed Apr. 5, 2005, which claims priority under 35 U.S.C. §119 of Austrian Patent Application No. A 625/2004, filed Apr. 9, 2004.

BACKGROUND OF THE INVENTION

1. Field of the Invention

The invention relates to a method for filling a container with gas, the gas being inserted into the container under compression.

The subject matter of the invention is furthermore a use of electrically conducting stretched material.

Finally, the invention covers a gas container, in particular a high-pressure gas cylinder, for storing gases under pressures exceeding 50 bar, in particular exceeding 200 bar.

2. Discussion of Background Information

Combustible gases such as methane or ethane represent important energy sources for a plurality of processes. Such gases are normally stored in transportable gas containers, which makes it possible to transport the gases and thus the energy sources easily to the location of demand or also to carry along with a working device.

In order to be able to provide as much gas and thus as much energy as possible with a gas container without refilling, gases are inserted into gas containers under compression, pressures of up to several hundred bar being used. The higher the pressure used, the more gas can be inserted into the container at a given temperature. Consequently, the gas containers need to be filled less often and thus need to be transported to a refilling facility less often, the higher the pressure during filling.

During filling the compression of a gas to a desired pressure causes an increase in the temperature of the gas in addition to a desired compression of the same. This naturally caused increase in temperature is undesirable and unfavorable, because with a preset volume and pressure less gas can be inserted into a container when the gas temperature is higher. To put it another way: with otherwise identical variables, the filling level or the quantity of the inserted gas is lower when the temperature is higher.

Another problem when filling a gas container with the injection of gas lies in the occurrence of high pressure peaks that are attributable to the fact that the gas is inserted into a gas container directed as a jet. The containers used should therefore have a high wall thickness in order to be able to withstand pressure peaks.

SUMMARY OF THE INVENTION

The present invention provides a method for filling a container with gas including inserting an electrically conducting stretched material into the container before inserting gas into the container, and inserting gas into the container under compression.

In one embodiment, the stretched material is inserted with a volumetric content of 0.5 to 8.5 percent of the total volume of the container. In another embodiment, the stretched material is inserted with a volumetric content of 1.0 to 5.0 percent of the total volume of the container In one embodiment, the stretched material is inserted into the container in the form of separated spherical or cylindrical forms. In yet another embodiment, the stretched material is arranged in the container ascending from a base of the container.

In one embodiment, the stretched material is uniformly distributed throughout the entire volume of the container.

In one embodiment, the gas includes a combustible gas. In another embodiment, the gas is injected into the container, and the container has a pressure of at least 200 bar.

In one embodiment, the container comprises a steel vessel.

In one embodiment, the stretched material is made of a light metal, such as for example, aluminum or an aluminum alloy. In another embodiment, the stretched material is made of plastic In one embodiment, the stretched material is surface-treated to increase conductivity.

The present invention also provides a method of using an electrically conducting stretched material to compress a gas including contacting the electrically conducting stretched material with a gas in a container under a compressed atmosphere.

The present invention also provides a gas container for storing gases under pressures exceeding 50 bar including an electrically conducting stretched material.

In one embodiment, the electrically conducting stretched material in the gas container has a volumetric content of 0.5 to 8.5 percent of the total volume of the container.

In one embodiment, the stretched material is arranged in the area of an opening of the gas container.

In one embodiment, hollow space of the gas container is filled up with at least one electrically conducting filling body made of stretched material and a filling pipe having an outlet opening is provided for filling, where the filling pipe leads up to the geometric center of the gas container and a ground connection is connected in the area of an outlet opening.

In on embodiment, the filling pipe projecting into the hollow space contains several smaller outlet openings arranged evenly spaced from each other, in the areas of which respective ground connections are arranged.

In one embodiment, the electrically conducting filling body made of stretched material is arranged in the upper filling area, and wherein the electrically conductive filling body is embodied as a pouch hanging in a sack-like manner and is attached to the underside of the cover as partial filling.

In one embodiment, the electrically conducting filling body is arranged in an upper filling area, and wherein the electrically conductive filling body fills up a cross section of the container in a screen-like manner and corresponds to a height of 1/10 to 1/20 of the container height.

In one embodiment, at least one of the electrically conducting filling bodies are supported in a support ring with a supporting grid attached thereto and comprise replaceable packings.

In one embodiment, the electrically conducting filling body acts as a flame barrier and damps pressure peaks during the filling operation.

In one embodiment, the gas container is configured to store gases under pressures exceeding 200 bar.

In one embodiment, the stretched material is has a volumetric content of 1.0 to 5.0 percent of the total volume of the container.

The object of the invention is now to disclose a method of the type mentioned at the outset in which a high filling level is achieved with given volume and given pressure and with which containers with smaller wall thickness can be used without a safety risk.

Another objective of the invention is to describe a use of electrically conducting stretched material.

Finally, it is an objective of the invention to disclose a gas container of the type mentioned at the outset, which can be filled with an increased amount of gas at a given pressure.

The objective of the invention in terms of method is achieved in that with a generic method electrically conducting stretched material is inserted into the container before it is filled with the gas.

The advantages of a method according to the invention are to be seen in particular in that electrically conducting stretched material causes an efficient cooling of the gas that is subsequently inserted under compression. Heat is thereby extracted so effectively from the inserted gas through the stretched material present that its temperature can be reduced by several degrees Celsius compared to a gas filling without stretched material. Despite the insertion of stretched material, which in turn takes up part of the free volume, a higher filling level than before can thus be achieved with preset volume and pressure.

Another advantage can be seen in that the stretched material is suitable for dispersing in many different directions a directed gas jet entering the container, whereby gas pressure peaks can be largely eliminated. It is now advantageously possible to use gas containers with smaller wall thickness than before and thus to save material in the production of gas containers because the gas containers can be designed for smaller local pressure peaks.

Another advantage lies in the fact that the inserted stretched material is electrically conducting. This reduces the risk of a critical ignition voltage being achieved locally during a filling.

In an advantageous variant of the method according to the invention, the stretched material is inserted with a volumetric content of the total volume of the container of 0.5 to 8.5 percent, preferably 1.0 to 5.0 percent. A volumetric content of at least 0.5, better at least 1.0 percent, is expedient for a good cooling effect. Volumetric contents higher than 8.5 percent contribute less to a cooling effect and increase a weight of the gas container disadvantageously. With respect to a good cooling with low weight, a volumetric content of the stretched material is kept below 5.0 percent.

It is particularly advantageous if the stretched material is inserted in the form of separated spherical or cylindrical forms. Such spherical or cylindrical forms can be produced as described in patent application EP 0 669 176 A2 and the content of this patent application is hereby explicitly incorporated herein in its entirety. A gas jet entering the container is split into partial jets at many points by means of a plurality of individual spherical/cylindrical forms, which are present orientated to one another in any desired manner. This very effectively reduces a risk of the occurrence of pressure peaks. Moreover, after being split into partial jets, the entering gas comes into contact with respectively different surfaces of the stretched material and can therefore be cooled simultaneously at many points, and thus cooled quickly.

It is particularly advantageous if the stretched material is arranged ascending from a base of the container. Oil possibly present in the container, which oil, e.g., has entered the container undesirably in the course of filling, is then fixed to the base by the stretched material and cannot leak out when gas is removed.

In order to achieve a uniform cooling and a very efficient splitting of a gas jet entering, it can be expedient for the stretched material to be uniformly distributed throughout the entire volume of the container.

A method according to the invention has proven effective with regard to reducing the risk of an ignition voltage being locally reached, in particular when a combustible gas is inserted.

The advantages of a method according to the invention are particularly effective when the gas is injected with a pressure of at least 200 bar.

It has also proven to be advantageous with a method according to the invention if a steel vessel is used as a container. Upon contact with the stretched material located in the interior of the container, heat absorbed by the stretched material can thus be dissipated to the steel and thus a cooling effect can be increased by dissipating heat to the outside.

In order to keep a weight of a container containing stretched material as low as possible, it is advantageous if stretched material of a light metal is used. Stretched material of aluminum or an aluminum alloy has proven to be excellent in this respect because the highest increases in filling levels are obtained with a low weight.

A filling level can be increased even further if surface-treated stretched material is used to increase conductivity.

It is also possible for stretched material made of plastic to be used.

The further objective of the invention is achieved through a use of electrically conducting stretched material during the compression of gases. The advantages achieved thereby can be seen in particular in that electrically conducting stretched material can have a cooling effect so that a heating of a gas during compression can be counteracted. Another advantage can be seen in that stretched material is suitable for splitting a gas jet into partial jets, whereby pressure peaks can be reduced. Another advantage can be seen in that stretched material can serve as an oil collector.

With regard to minimizing weight, it is thereby advantageous if the stretched material is made of light metal.

Metal containers or those of plastic or compound materials, e.g., combinations of metal and plastic, can be used as gas containers. Due to their physical properties, suitable plastics are in particular those from the group of amides, e.g., polyamides sold under the trade name Kevlar.

If the gas container is a steel cylinder, with contact between the stretched material and the gas container, a good heat dissipation to the outside can be achieved and a higher filling level can be achieved.

The object of the disclosure of a gas container, in particular a high-pressure gas cylinder, for storing gases under pressures exceeding 50 bar, in particular exceeding 200 bar, which can be filled with a large quantity of gas at a given pressure, is attained if the gas container contains electrically conducting stretched material.

An advantage of a gas container according to the invention can be seen in that the gas container with given pressure can be filled with a larger amount of gas than before. Moreover, stretched material causes a reduction of pressure peaks which are caused by inserted gas and stress an interior wall of the container. Due to a reduction of pressure peaks, it is now possible to design containers with smaller wall thickness without creating a safety risk. Overall, gas containers can therefore be provided with lower weights than before, despite being filled with stretched material.

Another advantage can be seen in that electrically conducting stretched material counteracts an ignition voltage being reached, because high local electrostatic voltages in the interior can be at least largely avoided by dissipation via the stretched material.

It is favorable if the stretched material has a volumetric content of the total volume of the container of 0.5 to 8.5 percent, preferably 1.0 to 5.0 percent.

If the stretched material is present in the form of separated spherical or cylindrical forms, gas entering can be split into many partial jets and thus brought into contact with stretched material on many different surfaces, whereby pressure peaks can be minimized and cooling effects can be maximized.

In order to achieve a bonding of the oil located in the interior of the container, the stretched material can be arranged ascending from a base of the container.

An effective gas cooling and a reduction of pressure peaks in the entire interior of the container can be achieved if the stretched material is uniformly distributed throughout the entire volume of the container.

It can also be advantageous to arrange stretched material in the area of an opening of the gas container. In this case, gas entering will be split into partial jets directly upon entering and cooled at the entrance site.

If the hollow space of the gas container is filled with filling bodies made of electrically conducting stretched material and a filling pipe having an outlet opening is provided for filling, which filling pipe leads to the geometric center of the gas container, and a ground connection is connected in the area of the outlet opening, it is ensured that the temperature does not rise during the filling operation and thus a greater filling results, and that an electrical charge is dissipated during formation.

It is also advantageous if a filling pipe projecting into the hollow space contains several smaller outlet openings arranged at equal distances, in the areas of which outlet openings ground connections are respectively arranged. Thus for larger gas containers, such as tank cars or the like, a uniform outflow of the medium is achieved during filling and an electrical charge is avoided at an early stage.

An electrically conducting filling body made of stretched material can thereby be arranged in the upper filling area, which filling body can be embodied as a pouch hanging in a sack-like manner attached to the underside of the cover as a partial filling. A better filling is thus achieved, since the temperature does not rise during the filling operation. The electrical charge hereby is already dissipated in the filling area.

It is advantageous if in the upper filling area a filling body is arranged that fills up the cross section of the container in a screen-like manner and corresponds to a height of 1/10 to 1/20 of the container height. A uniform filling is thus achieved that also helps considerably to avoid pressure peaks occurring.

It is also advantageous if the filling bodies are supported in a support ring with a supporting grid attached thereto and comprise replaceable packings. It is thus easy to replace the filling bodies, e.g., for cleaning purposes.

It is furthermore advantageous if the filling bodies are connected to the shell of the container via a ground connection. The electrical charge is thus dissipated in a simple manner with a joint ground connection.

Finally, it is advantageous if the filling body serves as a flame barrier and damps the pressure peaks during the filling operation. A safe filling is thus possible. Sources of danger occurring, such as explosions or the like, are thus nipped in the bud.

BRIEF DESCRIPTION OF THE DRAWINGS

The invention is explained below in more detail based on exemplary embodiments. They show;

FIG. 1: Longitudinal section of a gas container with filling pipe;

FIG. 2: Longitudinal section of a gas container for larger dimensions;

FIG. 3: Longitudinal section of a gas container with partial filling;

FIG. 4: Longitudinal section with support of stretched material;

FIG. 5: Section of the support location

DETAILED DESCRIPTION OF THE INVENTION

Increasing the Filling Level

Stretched material of a surface-treated aluminum alloy foil was produced as described in EP 0 669 176 A2. The separated cylindrical forms thus obtained were placed in three different high-pressure gas cylinders made of steel that were designed for pressures up to 500 bar.

The stretched material was present in the interior of the containers, ascending from the base, whereby stretched material was used respectively in a volumetric content of 1.5 percent by volume, based on the free interior volume of the gas container. High-pressure gas cylinders without stretched material were respectively used for comparison purposes.

The high-pressure gas cylinders filled with stretched material and the unfilled high-pressure gas cylinders were subsequently filled with methane gas ($CH_4$), whereby the gas was compressed by means of a compressor to pressures from approx. 200 bar (examples 1 and 2) to approx. 300 bar (examples 5 and 6). The gas temperature was measured respectively in the interior of the high-pressure gas cylinders.

Results of the filling, based on 100 L fill volume, are shown the table below.

It is shown that, under constant conditions, i.e., the same pressure and the same interior volume of the gas cylinders, comparatively more gas can be inserted into high-pressure gas cylinders filled with stretched material than in unfilled ones.

| | High-pressure gas cylinder | | | | | |
|---|---|---|---|---|---|---|
| | 1 | 2 | 3 | 4 | 5 | 6 |
| Fill volume [L] | 100 | 100 | 100 | 100 | 100 | 100 |
| Fill pressure [bar] | 200 | 200 | 250 | 250 | 300 | 300 |
| Stretched material [% by vol.] | 0 | 1.5 | 0 | 1.5 | 0 | 1.5 |
| Gas temperature [° C.] | 40 | 34.5 | 50 | 42 | 60 | 50 |
| Fill weight [kg] | 13.83 | 14.08 | 16.75 | 17.18 | 19.50 | 20.11 |
| Weight difference [kg] | | 0.25 | | 0.43 | | 0.61 |
| Filling level increase [% by weight] | | 1.8 | | 2.6 | | 3.1 |

Filled high-pressure gas cylinders as described above have many applications. A use of such high-pressure gas cylinders for gas-operated vehicles, in particular automobiles, has proven to be a particularly advantageous application. In this field a higher filling level is directly reflected in a greater range. In connection therewith, it is important from a safety point of view that downstream valves and membranes are conserved by a reduction of pressure peaks even during gas removal, so that service or repair expenditure is low. Moreover, the high safety requirements for fuel containers given in the area of passenger transportation are satisfied in that electrically conducting stretched material reduces internal friction and thus counteracts an electrostatic charge.

Gas Containers

Possible embodiments of a gas container according to the invention are explained in more detail below based on the figures.

FIG. 1 shows a gas container 1, the shell 2 of which is embodied in a tubular manner and on the underside contains a base 3 curved inwards. A flange 4 is located at the top end, which flange can be closed with a cover 5 by means of a screw joint 6. A filler neck 7 is arranged in the center of the cover 5, on which filler neck a valve 8 sits. A filling pipe 9 is guided into the interior of the gas container 1. An outlet opening 10 of the filling pipe 9 is chosen such that it lies in the geometric center of the gas container 1. A filling body 11 made of electrically conducting stretched material is inserted in the interior of the tubular gas container 1. The electrical charge 12 occurring here during filling is indicated by a dotted circle. In the area of the outlet opening 10 a ground connection 13 is installed which, together with the ground connection of the shell 2, leads to the outside.

FIG. 2 shows a gas container 1 that comprises a shell 2 in the same way and is closed at the bottom with a base 3 curved inwards. Again a flange 4 is attached at the top, which flange is closed with a cover 5 by means of a screw joint 6. A filling pipe 14 is guided through the filler neck 7, which filling pipe now leads further downwards into the interior of the gas container 1. The filling pipe 14 contains a number of smaller outlet openings 15, e.g., spaced apart uniformly, through which the medium to be inserted reaches the gas container 1. The electrical charge 16 forms at the outlet openings 15 and is indicated respectively by a dotted circle. Now the ground connection 13 is installed in this circle, which ground connection leads to the shell 2 and is dissipated to the outside. This embodiment is suitable not only for larger gas cylinders, but is also designed for tank cars or other large stationary installations for storing combustible gaseous or liquid media.

FIG. 3 shows another variant of a gas container 17 that is composed of a tubular shell 18 and is closed at the bottom with a base 19 curved inwards. At the top a flange 20 is welded to the shell 18, that can be closed by means of a cover 21 by a screw joint 22. A filler neck 23 is arranged in the center of the cover 21. A pouch 24, e.g., of stretched material, is arranged in the interior of the gas container 17 below the flange 20 or cover 21, in which pouch the filling body 25, likewise made of electrically conducting stretched material, is filled as partial filling. A ground connection 26 leads from this filling body 25 to the shell 18 and afterwards discharges to the outside the electrical charge, which occurs during filling, in the formation phase of the charge during the filling operation.

FIG. 4 shows another variant of a gas container 17, the tubular shell 18 of which is closed at the bottom with a base 19 curved inwards. At the top, the shell 18 is attached with a flange 20, which in turn, provided with a cover 21, is closed by a screw joint 22. The filler neck 23 is arranged in the center. A support ring 27 is attached in the upper area of the gas container 17, which support ring can be embodied, e.g., as an angle ring. A supporting grid 28 is attached in this support ring 27, on which supporting grid a filling body 29 lies. This filling body comprises an electrically conducting stretched material that advantageously comprises a number of packings and, if needed, can be replaceable. The height of these packings corresponds to approx. 1/10 to 1/20 of the height of the gas container 17. The ground connection 26 is directly connected to the filling body 29 and prevents the electrical charge occurring during the filling of the medium.

FIG. 5 shows the section A of FIG. 4, whereby the embodiment of the support ring 27 is more clearly emphasized. This support ring 27 is preferably embodied as an angular ring and has a branch directed inwards. A supporting grid 28 is attached to this branch of the support ring 27. This supporting grid bears the filling bodies 29 that have a height 30 and preferably can also be embodied as replaceable packings. It is essential that the filling bodies 29 fill up the entire cross section of the gas fill container 17 and are connected to a ground connection 26.

The embodiments of gas containers described on the basis of the figures have the advantages that the incipient electrical charge is already dissipated during the filling operation and stretched material simultaneously serves as a flame barrier and is used as oil residue holder. It is also important that the filling body serves as a cooling body and thus renders possible a high filling level. Gas containers 1, 17 are also suitable for an at least partial filling with liquid media, such as solutions, e.g., toluene or silicone oil. This is important in that the fuelling intervals are considerably shortened with both mobile and stationary installations thus cutting costs, since the storage stations do not need to be visited so often.

The invention claimed is:

1. A gas container for storing gases under pressures exceeding 50 bar comprising an electrically conducting stretched material, wherein hollow space of the gas container is filled up with at least one electrically conducting filling body made of stretched material and a filling pipe having an outlet opening is provided for filling, wherein the filling pipe leads up to the geometric center of the gas container and a ground connection is connected in the area of an outlet opening.

2. The gas container according to claim 1, wherein the filling pipe projecting into the hollow space contains several smaller outlet openings arranged evenly spaced from each other, in the areas of which respective ground connections are arranged.

3. The gas container according to claim 1, wherein the electrically conducting filling body made of stretched material is arranged in the upper filling area, and wherein the electrically conductive filling body is embodied as a pouch hanging in a sack-like manner and is attached to the underside of the cover as partial filling.

4. The gas container according to claim 1, wherein the electrically conducting filling body is arranged in an upper filling area, and wherein the electrically conductive filling body fills up a cross section of the container in a screen-like manner and corresponds to a height of 1/10 to 1/20 of the container height.

5. The gas container according to claim 1, wherein at least one of the electrically conducting filling bodies are supported in a support ring with a supporting grid attached thereto and comprise replaceable packings.

6. The gas container according to claim 1, wherein the electrically conducting filling body acts as a flame barrier and damps pressure peaks during the filling operation.

* * * * *